US008545283B2

(12) United States Patent
Richter

(10) Patent No.: US 8,545,283 B2
(45) Date of Patent: Oct. 1, 2013

(54) INTERACTIVE DOLL OR STUFFED ANIMAL

(75) Inventor: Wolfgang Richter, Starnberg (DE)

(73) Assignee: Ident Technology AG, Wessling (DE)

( * ) Notice: Subject to any disclaimer, the term of this patent is extended or adjusted under 35 U.S.C. 154(b) by 1093 days.

(21) Appl. No.: 12/366,810

(22) Filed: Feb. 6, 2009

(65) Prior Publication Data

US 2009/0209170 A1 Aug. 20, 2009

Related U.S. Application Data

(60) Provisional application No. 61/066,420, filed on Feb. 20, 2008.

(51) Int. Cl.
*A63H 3/28* (2006.01)

(52) U.S. Cl.
USPC ..... 446/297; 446/268

(58) Field of Classification Search
USPC ..... 446/297
See application file for complete search history.

(56) References Cited

U.S. PATENT DOCUMENTS

| | | | | |
|---|---|---|---|---|
| 3,774,110 | A * | 11/1973 | Roveti | 324/133 |
| 4,272,916 | A * | 6/1981 | Giordano et al. | 446/270 |
| 5,413,518 | A * | 5/1995 | Lin | 446/454 |
| 5,606,494 | A * | 2/1997 | Oshima et al. | 700/59 |
| 6,354,842 | B1 | 3/2002 | Frei | 434/365 |
| 6,570,487 | B1 * | 5/2003 | Steeves | 340/5.2 |
| 6,629,242 | B2 * | 9/2003 | Kamiya et al. | 713/100 |
| 6,834,251 | B1 * | 12/2004 | Fletcher | 702/150 |
| 2001/0020837 | A1 | 9/2001 | Yamashita et al. | 318/567 |
| 2003/0214524 | A1 | 11/2003 | Oka | 715/700 |
| 2004/0043696 | A1 * | 3/2004 | Suzuki | 446/268 |
| 2004/0119342 | A1 * | 6/2004 | Sato et al. | 307/652 |
| 2006/0154559 | A1 * | 7/2006 | Yoshida | 446/297 |
| 2007/0128979 | A1 * | 6/2007 | Shackelford et al. | 446/484 |
| 2008/0160877 | A1 * | 7/2008 | Lipman | 446/268 |

FOREIGN PATENT DOCUMENTS

| | | | |
|---|---|---|---|
| DE | 102006046515 | 4/2008 | |
| DE | 102007016408 | 10/2008 | |
| DE | 102007020873 | 10/2008 | |
| KR | 2003060375 A * | 7/2003 | |
| WO | 00/45250 A | 8/2000 | A63F 13/00 |

OTHER PUBLICATIONS

International Search Report and Written Opinion, Application No. PCT/EP2008/006407, 13 pages, Apr. 24, 2009.

* cited by examiner

*Primary Examiner* — Tramar Harper
(74) *Attorney, Agent, or Firm* — King & Spalding L.L.P.

(57) ABSTRACT

A toy has a body in the form of a doll or a living being, an audio output to reproduce audio effects, a memory to provide audio data, a controller to control the reproduction of different audio effects based on the reading of the audio data, and a sensor for generating detection signals correlated with the proximity of an object to the toy. The controller is designed in such a way that a selection of the reproduced audio effects depends on an evaluation of the detection signals and of signals generated by a provided interface device that is connected through devices in the play accessories being fed to that controller, and/or being made available for access.

34 Claims, 17 Drawing Sheets

Circuit of the Multi-Input/Operations Amplifier MOP

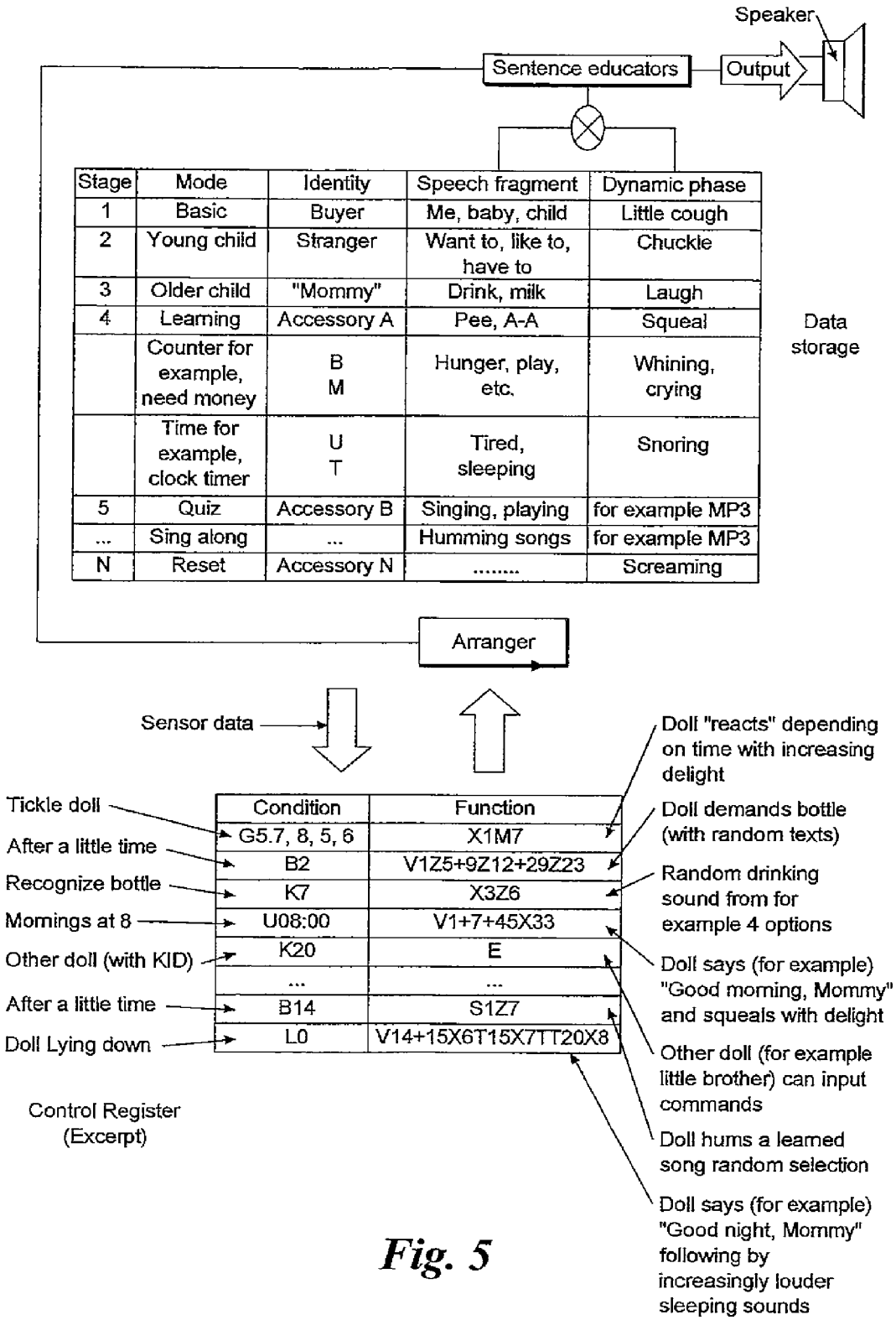

| Stage | Mode | Identity | Speech fragment | Dynamic phase |
|---|---|---|---|---|
| 1 | Basic | Buyer | Me, baby, child | Little cough |
| 2 | Young child | Stranger | Want to, like to, have to | Chuckle |
| 3 | Older child | "Mommy" | Drink, milk | Laugh |
| 4 | Learning | Accessory A | Pee, A-A | Squeal |
| | Counter for example, need money | B M | Hunger, play, etc. | Whining, crying |
| | Time for example, clock timer | U T | Tired, sleeping | Snoring |
| 5 | Quiz | Accessory B | Singing, playing | for example MP3 |
| ... | Sing along | ... | Humming songs | for example MP3 |
| N | Reset | Accessory N | ..... | Screaming |

| Condition | Function |
|---|---|
| G5.7, 8, 5, 6 | X1M7 |
| B2 | V1Z5+9Z12+29Z23 |
| K7 | X3Z6 |
| U08:00 | V1+7+45X33 |
| K20 | E |
| ... | ... |
| B14 | S1Z7 |
| L0 | V14+15X6T15X7TT20X8 |

*Fig. 5*

*Random-controlled Speech Sequence*

| Randomness number | Subject | RND | Predicate | RND | Object | RND | Optional |
|---|---|---|---|---|---|---|---|
| 1 | I | 1 | Wants | 1 | Drink | 1 | Gesture 1 |
| 2 | Baby | 2 | Needs | 2 | Milk | 2 | Gesture 2 |
| 3 | Child | 3 | Wants to | 3 | Bottle | 3 | Gesture 3 |
| 4 | Petey | 4 | Must | 4 | Glug-glug | 4 | Gesture 4 |

Table 1

*Fig. 6*

| *Command* | *Code* | *Function* | *Example* |
|---|---|---|---|
| Analog reading | *G* | Inputs gestures and compares them with paramaters | G12-13-14-15 |
| KID recognized? | *K* | Determine accessory, reaction if present | K7 |
| Speech output | *V* | Forms sentences and speaks numbered speech fragments | V1+15+7 |
| Time | *U* | Compares time | U17:30 |
| Timer | *T* | Counts value backwards every second | T25 |
| Position | *L* | Queries the position sensor | L>2<5 |
| Monotony | *M* | Counts repeated gestures | M10 |
| Need | *B* | Counter, in/decreases every minute | B10S5+8 |
| Mixer | *X* | Mixes sounds or music | X34 |
| Randomness | *Z* | Searches for a prior and later value | V5Z12 |
| I/O BitTest | *?* | Tests whether a bit has been set | ?4 |
| Set I/O Bit | *!* | Sets one bit | T10!5 |
| Sing song | *S* | Hums a previously saved sound | S1 |
| External | *E* | Command is input and then immediately executed | E |
| Point counter | *P* | Counts, for example, quiz points | P7+50 |

*Command Interpreter*

(example)

Table 2

*Fig. 7*

INTERACTIVE DOLL OR STUFFED ANIMAL

CROSS REFERENCE TO RELATED APPLICATION

This application is related to provisional application No. 61/066,420 filed 20 Feb. 2008.

FIELD OF THE INVENTION

The invention is aimed at a toy in particular of the doll or stuffed-animal type that as such is provided with a device to produce sound effects, in particular to produce speech and/or animal sounds.

BACKGROUND OF THE INVENTION

For some time so-called talking dolls have been known that are provided with a playback device used to reproduce sound recordings. Stuffed animals are also known that are similarly provided with a playback device that can be used for generating animal sounds. These playback devices were originally realized as tape or phonograph playback devices. Their playback devices comprise electronic circuits that are provided with storage elements on which the sound sequence to be played is stored digitally, for example in MP3 format. These playback devices are generally provided with switches and can be activated to trigger the playback.

In addition to the above dolls and stuffed animals, dolls and animals are also known that are equipped with recording devices that permit a recording of sufficiently loud sound events. These recordings can then be played back by integrated sound generators with a slight time delay.

The company Ugobe Inc. manufactures an imaginary animal named "Pleo," which is a toy in the shape of a known dinosaur that is provided with a battery-operated mechanism used to perform certain walking, neck, and head movements. This toy is also provided with a plurality of sensors that make possible certain interactions with the toy.

OBJECT OF THE INVENTION

The object of the invention is to provide solutions via which a toy like a doll, animal, or imaginary creature can be created in which in particular speech or sound reproduction as well as interactions between the toy and a user appear to be less monotonous compared to a prior-art toy of this type and more like realistic interaction patterns.

SUMMARY OF THE INVENTION

This object is attained solved according to the invention with a toy having a toy body in the form of a doll or a living being, an audio output to reproduce audio effects, a memory to provide audio data, a controller to control the reproduction of different audio effects based on the reading of the audio data, and a sensor for generating detection signals correlated with the proximity of an object to the toy. The controller is designed in such a way that a selection of the reproduced audio effects depends on an evaluation of the detection signals and of signals generated by a provided interface device that is connected through devices in the play accessories being fed to that controller, and/or being made available for access.

This way it is possible in an advantageous fashion where appropriate to coordinate audio reproduction by hand proximity, in particular using gestures, with dolls, or a comparable toy. At the same time it is possible by grasping a toy, for example a bottle, or by touching other objects or symbols to cause the toy to produce speech or a sound meaningful for this context. It is possible to configure the controller such that for example a doll using a certain gesture (for example initial gesture) recognizes its principal reference person who is then greeted joyfully. This wholly new approach for the toy world makes it possible to make toys appear to act intelligent and engage in dialog.

The above interface device is preferably realized directly using electrodes of the sensor provided to detect the approach of objects. The data or signal transmission of those play accessories is done preferably by field electricity through phase-shift signal technology. The circuits integrated in the play accessories can be designed in such a way that they are equipped with their own energy sources and can generate relatively distinct displacement power events with signal transmission distances of ca. 50 cm. Alternatively, it is also possible to design these circuits installed in the toy accessory in such a way that they are operated by the doll functioning as a server provided with modulated alternating field and according to a specific modulation pattern create an impedance modulation that is detectable in the area of the doll and therefore to read the data content, the ID number, or where appropriate only a sufficiently specific frequency can be used.

According to an especially preferred embodiment of the invention, the sensor is designed in such a way that the proximity of the hand of a user, in particular, a playing child to the toy can be detected so that the hand approaching the toy represents the object detected by the sensor.

Using this sensor a gesture detector can be realized in conjunction with a corresponding evaluation circuit, through which certain movement patterns or gestures can be detected. The detection of these gestures can in particular be done by evaluating linear movement features of the detected objects. As linear movement features, in particular the motion paths of the detected object can be broken down into at least two spatial directions as well as in particular also the dynamics of the motion.

The gestures sensor can also be designed in such a way that it can be used to recognize certain states, such as a pointing motion with an extended index finger, the proximity of a flat hand with adjacent fingers and or also rapid finger movements of a number of bent fingers of the hand can be recognized by the respective typical field electric effects.

According to a particular aspect of the present invention, the sensor comprises at least one electrode that is connected to a circuit through which changes in the dielectric properties in the vicinity of the electrode can be detected. The circuit can also be designed in such a way that electrical events can be detected via them in the coupled electrode. These electrical events, as will be explained below, are generated by additional external circuits. It is also possible, in the area of the toy, in particular for example in the head or chin area of a doll, to provide a transmitting electrode, through which in the area in front of the doll torso an alternating field is coupled such that when the hand of a user is present, in particular the hand of a child playing with the doll, it causes a more intense input coupling of this field in the area of a detection electrode provided in the torso. The sensor can be designed in such a way that proximity detection and the detection of the gestures takes place on the basis of quasi static, field electric interaction effects.

The inventive toy, in particular the doll or toy can be an animal according to an additional aspect of the present invention, can also be provided with mechanical actuators that for example generate arm, lip, eyes or other body movement of the toy. The control of these actuators can similarly occur by resorting to evaluation results that are generated taking into account the proximity effects detected by the sensor.

According to a specific aspect of the present invention, the toy comprises a plurality of electrodes. Among these electrodes there is preferably a torso electrode through which the toy's proximity to the torso area can be detected. The sensor also comprises hand electrodes, in particular provided in the areas of the left and right hand surfaces electrodes, as well as foot electrodes, one head electrode and according to a specific aspect of the invention also a position sensor. This sensor family makes it possible to detect input events that make possible an especially meaningful dialog with the toy. Using the input signals generated by these numerous sensors different, realistic, meaningful dialog sequences or behavioral patterns of the doll can be produced.

It is possible to use at least one of the electrodes as an interface electrode via which a signal carrying a data string can be coupled, or at least one for the object-specific signal in the toy. This data string can be generated either through a corresponding transmitting electrode and an attached computer device or also through special circuit structures. These circuit structures can in particular be integrated into accessories such as for example bottles, plates, knives, spoons and forks, rings, articles of clothing, books or similar.

The toy can also be provided with an acceleration sensor, in particular including a position and motion sensor employing a viscous or free-flowing medium, through which in particular violent movements of the toy, as well as in particular a falling down of the toy can be recognized. Also the toy can be provided with a clock through which a time-appropriate coordination of the toy's behavior pattern can be achieved.

It is similarly possible to use the eyes of the doll or stuffed animal for generating the necessary signals for dialog. In this way it is possible to insert a camera in the eyes so that picture data generated by this camera can be stored on a memory preferably similarly installed in the toy. This picture data can be used for picture, in particular text recognition. Using an evaluation of the picture data can a speech reproduction can in particular be made that reproduces the text recognized by the text recognition.

It is possible to expand or alter the toy's vocabulary and/or response pattern by providing corresponding new or different data, in particular speech sequences through a data storage medium. This data storage medium is preferably provided with a wireless interface, in particular including the inventive electrode systems so that access can be obtained to the data content. This data storage medium can comprise a USB stick, or a different, preferably widespread standard-technology-compatible data storage medium. The corresponding speech content can then be loaded onto the data medium via a user portal, a community or also by the user or the parents. This data storage medium can be integrated into an accessory part such as school bag or a small book. As soon as this data storage medium is brought sufficiently close to the toy, in particular the doll or the animal, the controller inside the toy can access the data content. It is hereby possible to copy parts or the entire data content into the memory inside the toy, or to access this data via the controller inside the toy, as soon as these are needed due to the detected conditions.

It is possible to design the doll or toy in such a way that it has basic functions, whereby within the scope of an upgrade performance of this toy can be enhanced. It is possible to equip this toy with an interface system enabling communication with widespread mobile computers, in particular PDA's, Blackberrys or Gameboys. If necessary, an adapter system can be added to the above mobile computers so that the circuit structures and preferably surface electrodes function to make possible data transfer to the doll utilizing the doll electrode systems.

It is possible to design the doll-side circuit in such a way that when it recognizes adjacent sound or speech signals from the receiving electrodes it switches to reproduction mode that enables control of the internal sound reproduction circuits according to these circuits. In particular it is possible to design the doll-side circuit in such a way that it offers basic functions to a sufficient degree, such that via external input signals the doll can be switched to a control mode in which the doll's action pattern is essentially controlled by externally coupled signals.

The external provision of signals, in particular of speech reproduction signals can be done by data storage media that, for example, are on the market as aftermarket parts, advertising items, or accessories. It is possible, for example, to add a diaper pack, a detergent box or grocery bag, for example a fast food packaging of that data storage medium for example in the form of a small primer or small toy suitable for collecting. The toy, in particular the doll can when that data storage medium is present in the area of the toy, or by grasping of the data storage medium by the user reproduce data content as sound, in particular in the form of a speech sequence. It is possible to find in that accessory toy switching measures that allow the generating of certain information content by special handling of the accessory toy. In the case of the above bottle, it is for example possible to provide circuits that provide certain information content only after long shaking, or at a certain bottle temperature. The speech and sound reproduction can then store this information content. These accessory toys can be designed in such a way as to promote certain learning effects and in particular fine motor coordination.

The electrode and at least part of the detection circuit provided to operate the device can be realized by the preferably flexible circuit board installed in the toy. Using the electrode, an input system can be realized for multiple tasks, for example proximity detection, gesture detection, external signal coupling (ID transmitter), sleep mode/wakeup circuit. These functions can be realized with a small number of electrodes. In addition, static position and dynamic movements can be detected using this detection system in particular in conjunction with a viscous medium, for example gel, or a free-flowing medium. The toy can operate as a server and thereby form a detection and evaluation system through which signals from external signal transmitters and signal transmitters installed in accessory toys, in particular signals provided by impedance modulation can be detected. This signal transfer can where appropriate also include the child playing with the toy in the signal transmission path so that the doll can also detect signals from ID transmitters that are initially grasped by the playing child. The circuit board holder can be installed in the toy without specific installation equipment. The above gel can also form a pressure sensor installed in the toy. It is possible to adjust the properties of this gel medium in such a way that it can also be used to form a sensor system for magnetic fields and, where appropriate, an optical sensor. Signal detection via gel can be done when this gel is located sufficiently close to an electrode system preferably comprising a plurality of electrodes where field-electrical relevant interaction between the gel and the electrodes can be produced either through a change in position or shape of the space filled by the gel, and/or by a change in a state of the gel such as for example particle shifting (for example to form the magnet sensor) or change in density or other dielectric properties (temperature and pressure sensor).

The inventive concept can also be used to realize play accessories like a doctor's stethoscope that produces audible heart or breathing sound by placing it on the toy. These sounds can be generated either by the doll, or by the toy accessory. Applying the stethoscope to the arm area, for example, results only in producing heart sounds. Placing the stethoscope on the torso generates breathing sounds over heart sounds. Placing this accessory toy can generate other response patterns typical for the situation, for example, appropriate speech sounds or sneezing sounds. This concept makes it possible to realistically simulate for example taking pulse or blood pressure readings using corresponding play accessories.

The doll-side circuit is preferably operated in such a way that the absence of detection events over a given action period will switch it to energy-saving mode in which approach events search is done less frequently, for example only with an interval of 300 ms. If detection events are recognized in this sleep mode the search is raised again.

BRIEF DESCRIPTION OF THE DRAWING

Additional details and features on the invention are detailed in the following specification with reference to the drawing. Therein:

FIG. 5 is a schematic illustrating the generating of various audio effects, FIG. 6 is another drawing illustrating the generating of sentence sequences, FIG. 7 is a table illustrating the generating of speech and behavior effects.

SPECIFIC DESCRIPTION

Figure 1:
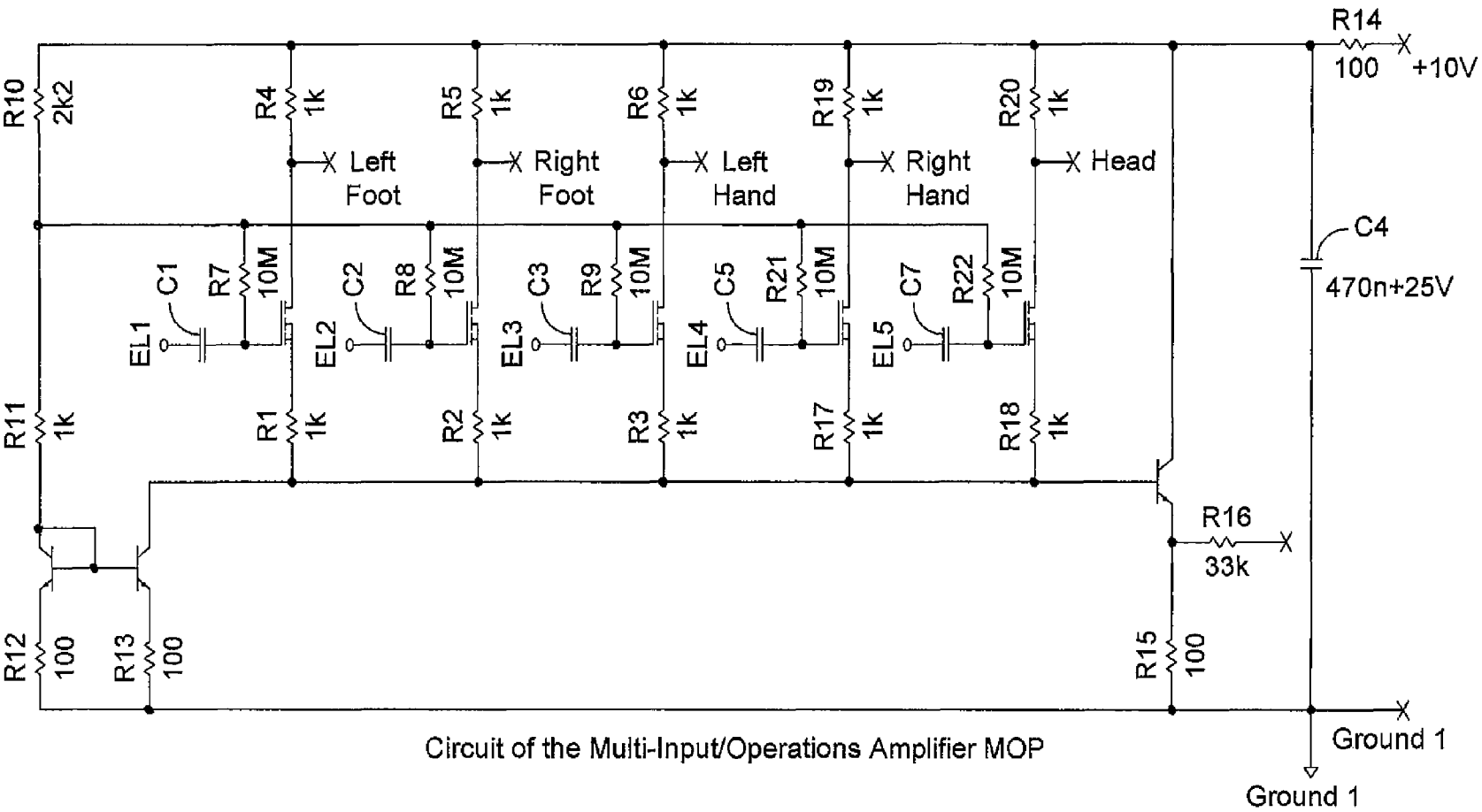
FIG. 1 is a schematic diagram illustrating the design of a sensor system with two foot sensors, two hand sensors and one head sensor.

The following sensors for generating gesture information described in greater detail below can in particular be realized resorting to circuit technologies that as such are disclosed in the applicant's patent applications DE 10 2006 046 515.6, DE 10 2007 016 408.6 and DE 10 2007 020 873.3. The content of the above applications is fully incorporated in the present application by this reference.

The inventive process makes it possible to make toys appear to be intelligent and therefore capable of dialog. The concept described below represents the possibilities of toys that interact and react.

By using inventive, supplemental driver software it is possible with the inventive toy to also operate other systems, such as personal computers and game consoles, as well as to control the toy with them. In particular, it is possible to use ID circuits developed by the applicant to influence the audio output or the doll via the PC and thereby to load or control with new data content, for example educational games and texts via the Internet.

Basic Principle

Various play sequences can be controlled by user gestures, in particular those of a playing child, which are performed in the direct vicinity of the toy (in particular without having to touch it). These gestures are interpreted by an evaluation computer and converted by a "control register" into functions stored therein.

The sensors preferably used to detect the gestures employ a technology through which effects on electrical fields or changes of dielectric properties are detected in an area surrounding the electrode systems, or corresponding signals can be produced. It is also possible to design the sensors in such a way that in a detection area objects defined by the sensors can be included that are provided with special electronics (for example ZPS circuits, or KID circuits) that require neither batteries nor antennas in order to operate. It is sufficient to introduce into the alternating field and the insulating grounds that usually occurs by grasping/touching the doll or the user to close a voltage circuit and to identify the objects. Touching of the KID elements by the user forms a signal bridge that as such enables a signal transfer from the user's body through modulated displacement power. This happens, for example, using an ID, for example, in the form of an identification number or a sequence of numbers that themselves are stored in the "control register" and can trigger a function. It is also possible to detect functions in combination with gestures and included objects (for example toy accessories, bottles, caps, shoes, "electronic" books, etc.) and to convert functions. The functions range from simple speech output components to complex mechanics involving the use of actuators.

It is in particular possible to control games using the gestures that are generated on the computer or TV screens. The following examples are explained using a doll. It is however possible to adapt these concepts to other games, types of games and variations.

Using the inventive concept it is possible to enhance children's enjoyment in playing with dolls. It is in particular possible using the inventive concept to coordinate speech production or mechanisms to move limbs, eyes, lips not in a monotonous way, but rather interactively. Using the inventive solution approach, a human/machine interface (HMI) integrated in a doll, or a comparable toy, which achieves varied response pattern handling the toy in a realistic way.

The inventive sensors can in particular can be formed by a support, for example a foil, which is designed using a flat electrode, which using at least one oscillator can produce a medium frequency electric alternating field (for example, 100 kHz). This foil can form additional electrodes at select positions that accept this alternating field and can amplify and pass it on using a transistor circuit (FIG. 1). This circuit forms a type of differential amplifier, (MOP) that only has at least as many inputs and outputs as recording electrodes are present. In addition, a composite output is provided. Since all electrodes receive equal amounts of current from the produced alternating field, there is initially no appreciable difference at its outputs. That changes when human limbs, for example the finger of a hand, are introduced into this field. At a distance of ca. 30 to 50 cm from the foil, the introduction of limbs is established by the differential by the above-described multi-operation amplifier (MOP).

Using at least one rectifier circuit, preferably a synchronous detector, the recorded levels weakened or amplified by limbs can be fed to an evaluation device, for example a microprocessor with an analog/digital converter (ADC) connected in series. After conversion each recording electrode receives a digital value that corresponds to a natural whole number. This number can be compared to a stored value. Stored functions can be accessed by correspondence to certain patterns, which correspond for example to a certain hand position of a player. This can be, for example, a speech issue.

Figure 2A:
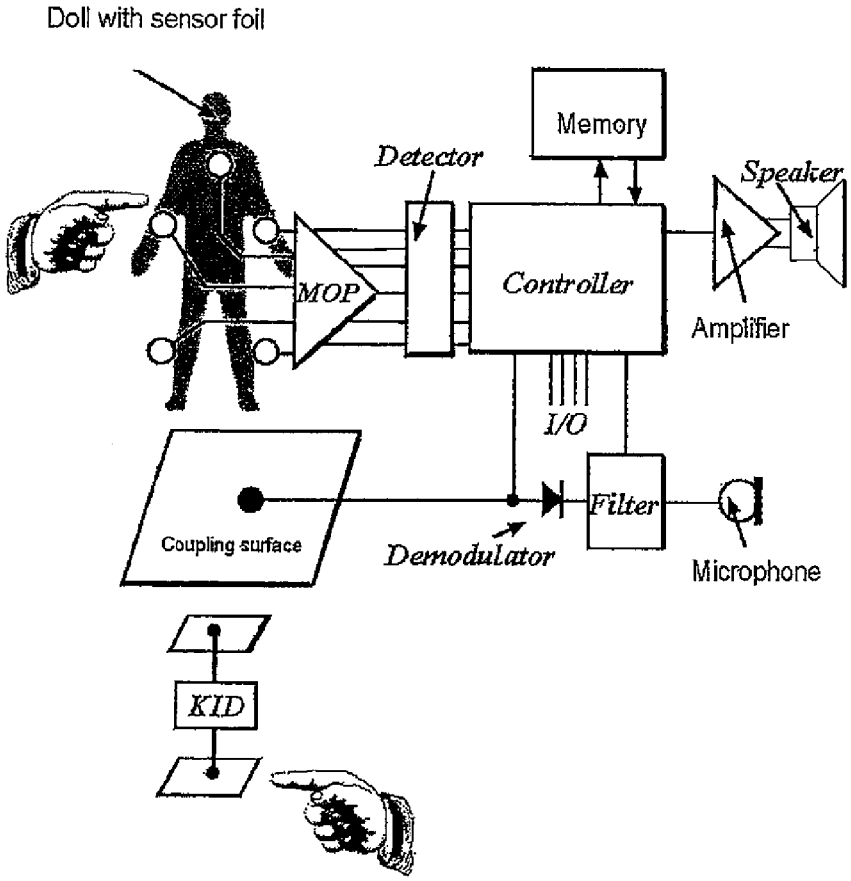
FIG. 2A is a schematic drawing illustrating the configuration of sensor electrodes for an inventive doll.

FIG. 2*a* shows the principle circuit configuration. The temporal sequence of the change in input limbs represents a gesture G. This can be presented in a varied form and also analyzed and interpreted in a variety of ways.

Certain gestures G can be used as so-called "initial gestures." This can for example be a secret sign that a playing child performs on for example a doll equipped with the inventive sensor. Not until an initial gesture is recognized does the doll switch according to the invention into a mode, for example by having a dialog only with the doll mother. When the doll is set down, this mode shuts down so that a person who does not know the initial gesture is "recognized and treated" differently by the doll, for example, by crying, screaming or the statement "I want to go to my mommy."

Figure 2B:
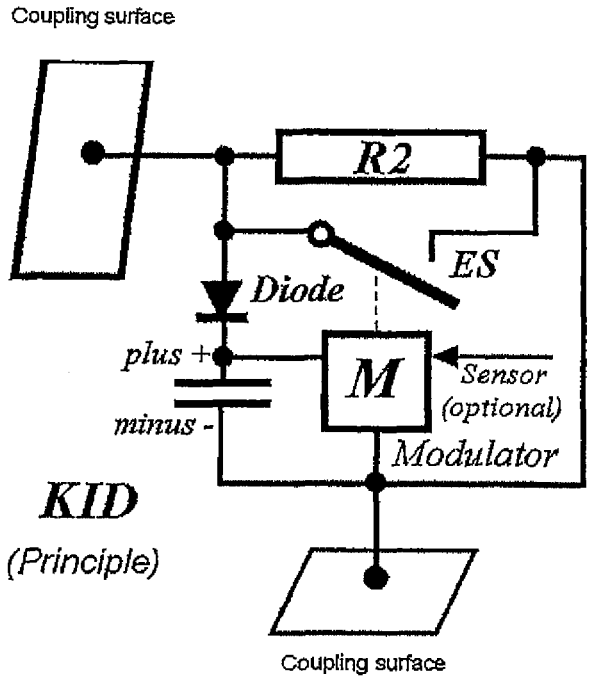
FIG. 2*b* is a schematic diagram illustrating the basic design of a transmitter element that is similarly recognizable in the inventive proximity detector device.

The generator producing the alternating field is also connected to at least one demodulator and filter circuit. If objects are introduced into the das alternating field that are provided with at least one capacitively working identity sensor (KID) these capacitively create a voltage for example through the player's hand and body against ground that causes the ID sensor to modulate the alternating field with its ID number (for example amplitude modulation) FIG. 2*b*. Using this concept it is in particular possible by placing a hand on the stomach of the doll and grasping objects, or touching pictures in a book equipped with a complementary circuit to cause the doll or toy to verbalize the correlated objects or pictures. Through this concept, a speech trainer can be formed using the toy through which the child playing with the toy can learn foreign-language words and sentences in a playful manner.

Almost any modulation process is suitable for the above. Preferably and for cost reasons, amplitude modulation is preferable. For example, KID's can be supplied from the alternating field and therefore advantageously not need their own energy source (battery) to operate. According to the invention, the evaluation electronics is able to recognize gestures G that occur near the foil and/or the input objects, equipped with a capacitive ID sensor (KID), and whose ID (number) is sent to a so-called "control register." As in a play, a play sequence can be "staged" by certain events triggering assigned functions. In addition to a control for speech issue V, which will be discussed in greater detail below, actuators can also be controlled by ports (I/O) that for example move the limbs of the doll, vibrate, open or close eyes or control pumps to intake or expel air and/or liquids. Such a "control register" acts intelligently when it is also provided with a so-called monotony analyzer (M). This is an electronic circuit that can be embodied in hardware and/or software and that determines how often a gesture is repeated. The temporal distance is measured between two hand positions and on reoccurrence this activates a counter (M). For example, it can be determined whether a playing child has tickled the doll's foot once, twice, three times or more times. Independent of the evaluation of the monotony analyzer M the control register can now made a kind of "intensity evaluation" and control the speech output accordingly. A light tickle will cause the doll to giggle. Longer tickling will cause the doll to laugh. If the tickling continues, the doll will squeal for joy until with continued use he will start to whine and finally begin to cry and scream. If the monotonous attitude is changed, for example stroking the cheeks, the same process would run in reverse until the doll calms down and is again smiling cheerfully.

Figure 3B:
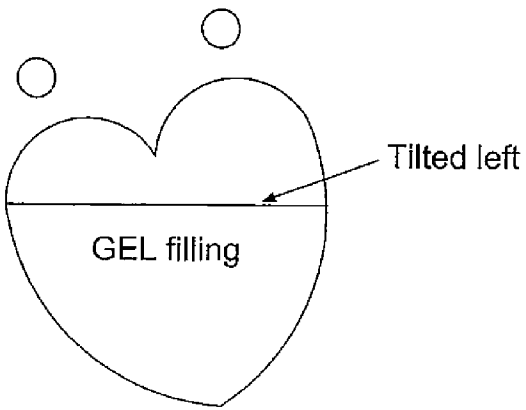
FIG. 3*b* is a schematic of the position sensor in a position tilted slightly to the left.
Figure 3A:
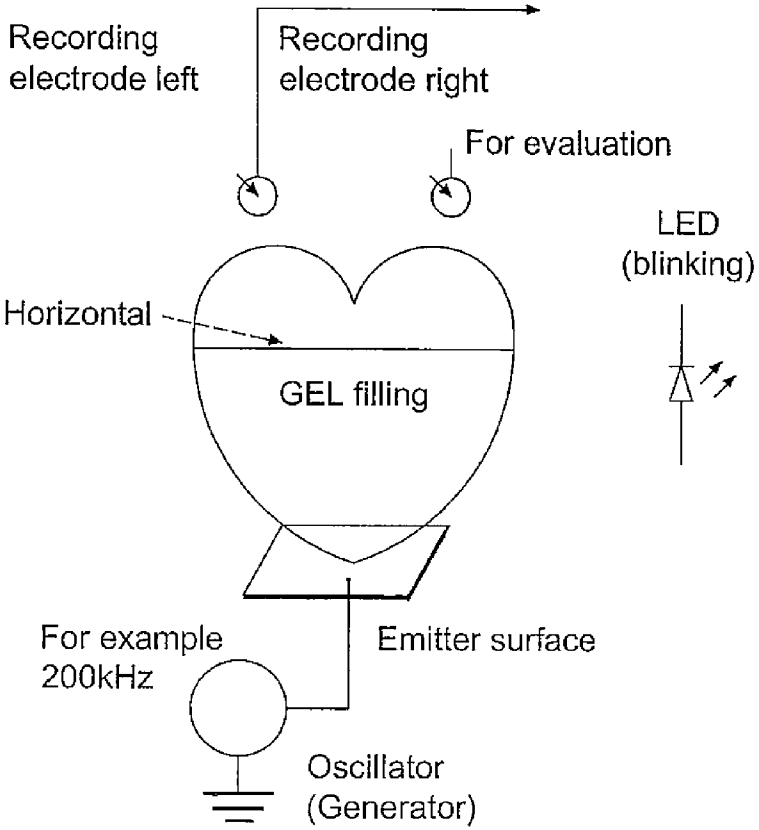
FIG. 3*a* is a schematic of a heart-shaped position sensor for generating position or orientation signals.

It is possible to equip the doll with a position sensor L that consists for example of a sealed liquid, in particular, a gel capsule (FIGS. 3*a*+*b*). Depending of the attitude/movement of the doll this gel capsule is fed more to one or the other alternating field recording electrodes thus determining the asymmetry of the multi-operations amplifier MOP. Here too the monotony analyzer (M) is involved to determine whether for example the child doll is being rocked in its sleep. If this continues for a long period of time the sleep stage progresses from light muttering to sleeping sounds and finally to a pleasant snore. The doll can then be put down until it moves again, then it wakes up and depending on degree of intensity and/or chance, it will scream or be happy. Here as well, a connected random-check generator Z can also contribute some variations. In order for all of this to be handled by the control, a software "arranger" can be added that selects the individual functions brings certain gestures G, installed accessories, which must be identified via KID, etc. into a certain sequence. The speech output essentially comprises stored speech fragments that the arranger organizes into meaningful sentences. Each fragment, as shown in Table 1 (FIG. 6) is assigned to a number of speech fragment variants (fragments) that makes it possible to reproduce a sentence in a varied form to limit the repetition of certain sentences. This happens to keep the toy from becoming boring due to constantly repeated sentences. In terms of software the evaluation circuit is supplemented by a need timer B, which for example can count up or down on a minute-by-minute basis to report when the toy for example has simulated hunger/thirst or wants to sleep or play, etc. This need timer B can also be coupled to a real-time clock U to help the player (the doll's mother) to go to bed with the doll at night and also to fall asleep with her and to get up in the morning (for example woken by the doll). It is possible using the detection electrode to form an interface system through which in particular the spoken vocabulary, and where appropriate it can also be expanded by different response pattern effects. In particular to realize the speech trainer function it is possible to house in an external element, for example a book-like accessory, a memory component that as such provides the data for an expanded reaction pattern, in particular speech reproduction pattern.

The arranger has access to the speech emitter V. These are saved speech fragments (for example child's speech), phrases and also sounds such as laughing, crying, screaming, splashing, gulping, gurgling/chuckling, burping, etc., as are typical for infants. A sound mixer (Mixer X) can in addition to heart beat sounds also play music that for example, sound like a music box (sleep aid) or also for example modern MP3 music titles or stories, etc. That is particularly advantageous to occasionally freshen the toy with new content. For this reason, a memory is preferably provided that can download content from external sources, such as CD-Rom or the Internet (known serial procedure).

Auto Calibration of the Electronics

The sensor circuit for gesture control monitors the level of the alternating field that is taken from the emitter surface, as it were until the flexibility changes the distances. Also if a toy, for example a doll, is held by the arm these fields can change, which can be interpreted. It is then however possible to form an offset and to subtract this from the entered values so that an e-field of a moderate balanced state is reestablished. In this way it is possible for example for a doll to be held in someone's arms and still react when one of its feet is tickled. However the control register can generate and process function numbers other than when this doll for example lies on the table or in a doll bed. This too is meant to train and promote social behavior.

The Real-World Interface RWI

The inventive electronics preferably comprises inputs and outputs to control actuators. These can be electrical motors, pumps, piezoelectric detectors and all known actuators that can be electrically switched on and off. It is also possible to use pneumatic or hydraulic systems that can be switched on and turned off electrically. The simplest actuators can be light-emitting diodes (LED) or pumps that can suck and expel air and/or liquids. Other sensors or switches can be queried their values that can be used for play.

Phrases and Sounds

Preferably certain speech phrases are stored in a memory and can be called up by the arranger of the control register of the evaluation electronics (for example a microprocessor, FPGA, DSC, etc.) and be made audible by at least one speaker connected to an amplifier (FIG. 5). Whole sentences can be made from individual phrases. These sentences and their formation can be functions of the control register. Additionally, variations can emerge. For example, the speech statement of a baby doll who wants to drink something according to Table 1 (FIG. 6) can be structured variably by the integrated random-check generator Z. One and the same sentence can be: "Baby wants bottle" or "Petey has to drink" or "I want milk," etc. According to the invention, word families are also created in the language/speech memory that match in terms of meaning and are selected by a random-check generator Z and are formed and uttered in a sentence with the help of the arranger. Additionally, this memory also contains sounds that can similarly be outputted using the mixer X. These sounds are meant to come from a child's world and can represent emotions (laughing, crying, screaming, or other body signals such as burping, etc.) Phrase selection is done using a so-called parser. Since the control register contains only function numbers and (preferably one-letter) commands (Table 2 FIG. 7), these must be provided through the arranger. This occurs using a sentence educator that is basically memory section when it is filled with the corresponding speech/sound fragment numbers that takes the associated words from the speech memory and outputs them through the mixer and amplifier.

It is possible to also load these sentence educators externally to initiate, arrange and/or trigger sentences from the outside. For example, referenced inventive capacitive ID sensor (KID) in case of proximity enter such a series into the electrical alternating field of the inventive sensor circuit, resulting in a speech sentence and/or an action. In this way a KID with sensors could be provided, for example to measure temperature. A bottle (with KID) for example could accordingly show a hot (warmed) or cold (cooled) content. In case of the proximity to the doll the alternating field would activate the KID circuit (for example provided with temperature sensor) present in it according to the invention. This would transmit the sensor value in the form of a sequence "hot" or "cold" and the baby could then say "the milk is cold" or "the milk is too hot," etc. The play attractiveness could also be significantly increased with the accessories, as well as the sale/purchase of accessories. A doll can also itself be provided with at least one KID so as to be recognized and/or to trigger certain (or random) functions in this doll in case of proximity to a second inventive doll (for example as brother or sister).

Syntax and its Interpretation in the Control Register

Control involves simple commands. For each function number that is created through gestures, speech input, inserted objects (KID), etc., the control register can contain at least one sequence that contains both the speech output (through the arranger and sentence educator) and the real word interface (input/output commands) I/O. In addition, random values can and should process and change intensity values and other numerical information. To do so, a memory-like syntax is used so that processing by microprocessor can be done without significant expense. An example: The command "V10Z15" would trigger the speech output of a phrase or sound selected randomly and issued from memory location 10 to 15. The command "V20B25" would, depending on the current status of the need counter B, select speech output sentences from 20 to 25 and then increase (I=intensity counter, M=monotony analyzer, Z=randomness, etc.). Table 2, FIG. 7 shows for example a number of commands and their function to which a control register can react.

The Inventive Position/Motions Sensor

This has for example the form of a heart (FIG. 3*a*) so that the gel contained inside can depending on the attitude (position) of the doll exit into the one or other chamber (FIG. 3*b*). It is possible to house the position sensor L near the field electrodes or to position respective electrodes in its vicinity that generate their own position-dependent signal from the feeding alternating field. Also, the movement of the doll can be dynamically measured and evaluated by the connected electronics using the safe contained gel. The consistency of the gel can also change depending on temperature in order to be able to obtain additional statements. The circuit contains where appropriate a temperature sensor in order to be able to establish the surrounding temperature and to take into account the play events.

FIGS. 3*a* and 3*b* show the effective principle. Unlike accelerometers, both static and dynamic behavior can be detected.

A First Inventive Embodiment

Figure 4:
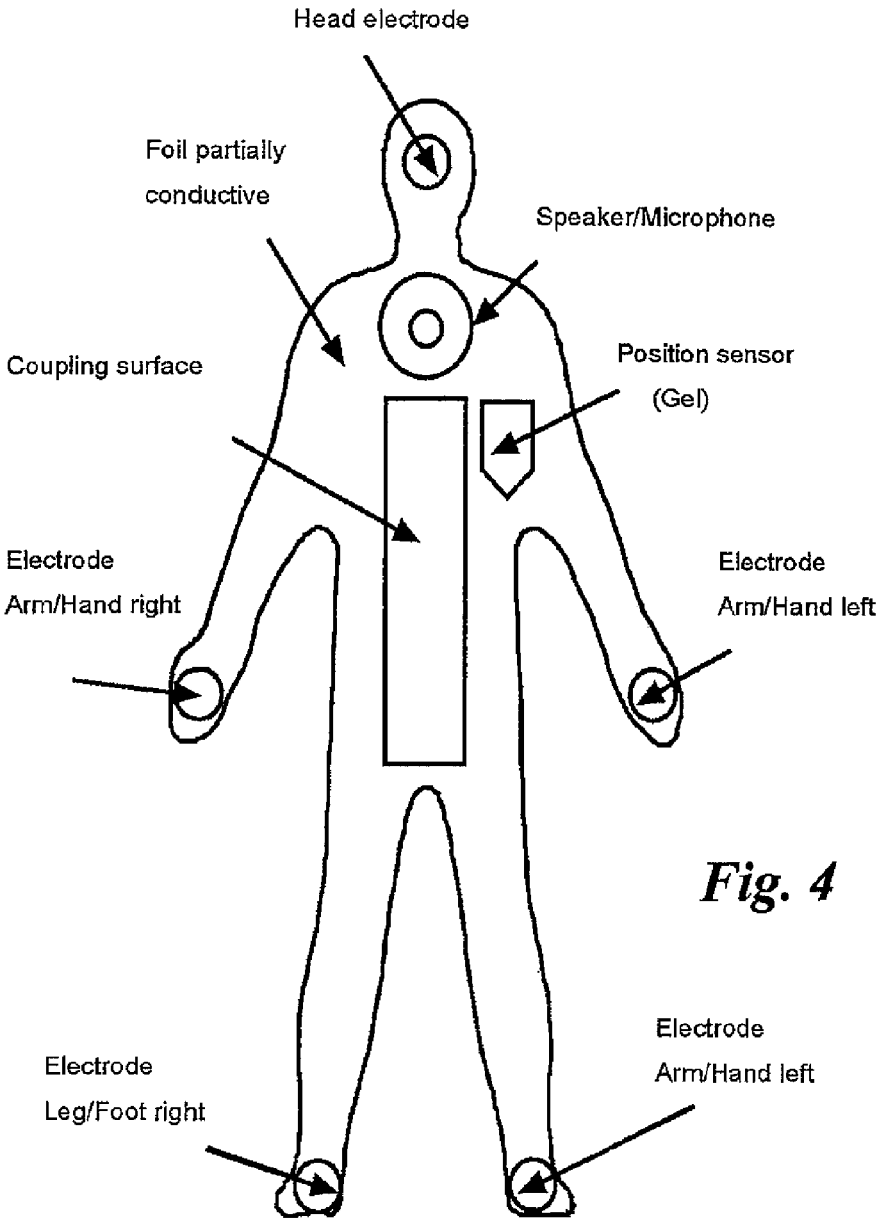
FIG. 4 is another schematic illustrating the configuration of the inventive sensors as well as a microphone/speaker as well as a position sensor for an inventive doll.

A foil circuit (FIG. 4), which can look like a somewhat reduced silhouette of a baby doll is made of a conductive material that can form alternating field and detector surfaces. Additionally, the detector electronics and the evaluation electronics in the form of an electronic component is applied to this foil, as is the hermetically sealed position sensor, in which a liquid and/or gel is located (FIG. 3*a*). This foil is simply inserted in the doll when it is assembled. The possibility of accepting a battery or a rechargeable power pack can be provided. The latter can be charged directly by connector or inductively, for example by placing the doll in the doll's bed. There are wide range of possibilities. A blinking LED can be installed under the position sensor that can make the heartbeat visible through the material of the doll as a gentle glow. The heartbeat can also be a sound from the speech memory that is continuously being mixed through the mixer X. The heartbeat can change quickly from fast to slow depending on the doll's emotional behavior (analog, "excitement" to "deep sleep"). At least one amplifier with speakers is provided to produce speech and/or sounds. Multi-channel output is also possible.

The electronic circuit can also be housed on conventional wafer material or otherwise. The sensor points can also attached to the corresponding places using wire or even capacitive ID sensor, i.e. they only need to be fed alternating current (e-field) capacitively within the doll, in which case they do not require a lead.

ADDITIONAL ADVANTAGEOUS EMBODIMENTS OF THE INVENTION

Quiz Mode

It is possible that the toy (for example a doll) contains speech texts that can represent quizzes. The player can answer question with, for example, gestures. A point counter control is easily installed in the electronics or their software, a point counter control that is operated by the inventive control register. Age and difficult levels can be adjusted. It is also possible to connect a speech input component to the control register so that for certain, spoken statements function numbers are available in the control register that can trigger the associated functions for speech input and/or gestures.

It is also possible, for example, to equip a small book with a KID circuit; if this book is brought into the area of the doll, the doll recognizes which page is using the signals generated by the KID circuit integrated in the book, and can for example speak an assigned text or ask questions. The answer can for example take the form of pointing gestures. For example, the book can show a pear and an apple; to answer the question "Where is the apple," the playing child can point to the apple with his/her finger. Hereby it intensifies a signal from the KID circuit in the reception area of the doll. The doll can then answer. A plurality of different meaningful answers by the playing child can be kept available for correct or incorrect actions that for example can be generated according to the randomness principle, or taking into account other criteria (for example time). This concept can also be used for different types of play.

"Sing-a-Long" Mode

The inventive circuit can be provided with a filter in the speech range (300 to 3400 Hz), with which the KIDs are queried, here it can also—using a microphone connection—input speech and sounds. In a specific embodiment of the invention it is possible to sing a sequence (for example "Little Hans"). The filter only gives basic sounds. The frequency evaluation in the electronics can determine notes and their duration, and output them using the singing sounds ("la la la," "hum hum," etc.) saved in the control register with or after the speech song input. In that way it appears as if the toy (the doll) "sings alone or hums along," when being sung to. It is also possible to save such sequences and to repeat them at a later point in time. The invention provides memory space for these. If the memory is full, certain song sequences can also be "forgotten" and must be retrained/learned. It is possible to assemble a choir from a number of toys whereby the individual toys, in particular dolls and animals through a coordination program for synchronicity and pitch preferably present in each toy similar to a dynamic network address that can actively be coordinated. The signal transfer between these individual toys is preferably done using the electrode systems on field electric paths. It is also possible to reserve response patterns or speech sequences for individual toys that can be meaningfully reproduced in the presence of additional corresponding toys or accessories.

Alarm Mode

If the sleeping child wakes up at night and cries this can be determined (using the installed clock) through U and the microphone and the doll can "try" to "calm" the child. At least one timer (B, U or T) can call up at certain times function numbers in the control register, for example to represent a wake-up function or to remind the child/the player of certain dates. The above microphone can also record volumes so that the doll can "complain" when it is too loud or "fall asleep" when it is too quiet, etc.

Another Example of Use It is possible to place the described electronics in the form of a for example coin-size device on a table and for example to connect them to a computer or game console (for example USB or Gampepad input). Gestures, for example, with the hand and/or installed KID (capacitive identity sensor) in turn generate function numbers that are sent to the computer. A driver installed in the computer, which can also contain and drive an inventive control register, converts these into game commands that can understand any and all computer games that can also operate conventionally with Gamepad, mouse, keyboard or joystick. Thus it is possible to control virtually every computer game using gestures that is certainly attractive. The external control register in the driver installed in the PC can in addition to mouse functions and key combinations also contain repeat and delay information and adapt to the respective game to be played.

It is similarly possible to connect the toy directly or indirectly to a computer to input and output data. It is also possible to play games on the screen with gestures shared by the doll, for example the correct way to put on diapers, etc. The invention creates a game control that makes it possible to create children's behavior, emotional response and dialog with the toy within the framework of social behavior. To do so it uses at least one electrical alternating field that is influenced by introducing human limbs, preferably hands and fingers, whereby the associated effects can be used in the toy's control register to arrange the definable or randomly/stochastically determined functions and to let them run. Due to the wide range of variations, the respective toy gives the impression of being an intelligent dialog partner. The circuit is preferably housed on a foil so that it can easily be installed in a movable toy (for example doll) where it is essentially non-destructive. A particular embodiment of the invention can serve as an input instrument for computer and console games. The invention provides the necessary driver circuits (software) for these.

According to a further aspect of the present invention, an electronic component is created in particular like components through which a plurality of combinable sensor functions can be realized in an especially effective fashion.

The inventive component makes it possible to realize a sensor system through which different interactions can be detected in a varied fashion. The invention essentially uses with great constructive freedom the possible configurations of flat electrodes for design and capacitive (alternating) fields. Charges that increase and decrease between these electrodes or can be changed on them in such a way using human limbs or the human speech (Electret microphone) that it results in an effect on the basic inventive component to be processed.

Figure 8:
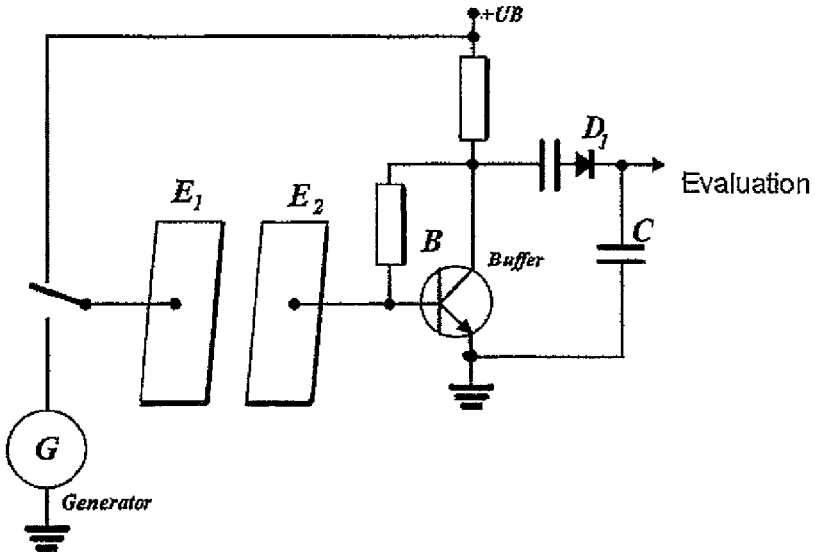
FIG. 8 is a circuit diagram illustrating the design of an inventive circuit.

FIG. 8 shows an electrode E1 that carries a charge that results in an electrical field affecting another electrode E2. The downstream connected resistor-capacitor configuration can reflect the charge so that it can be monitored (for example through an ADC). Alternating charges are easier to transmit through the air. It is therefore appropriate using a generating component G for generating alternating charges (generator). Using an evaluation device A such charges can be rectified, measured or processed using synchronous detectors.

Figure 9:
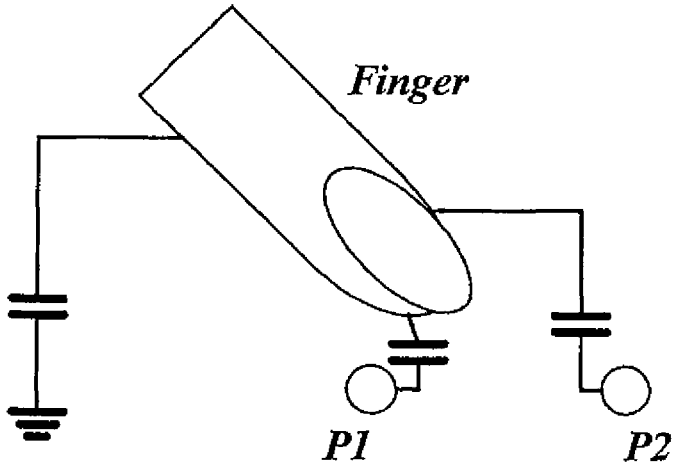
FIG. 9 is a simplified view illustrating a field bypass created using a finger.

FIG. 9 illustrates how human limbs between two points (P1 and P2) can form a capacitive bridge that changes its capacity according to proximity. At the same time, the human is also coupled capacitively to ground so that alternating current circuits can be created when human limbs capacitively approach or touch the alternating fields.

Figure 10:
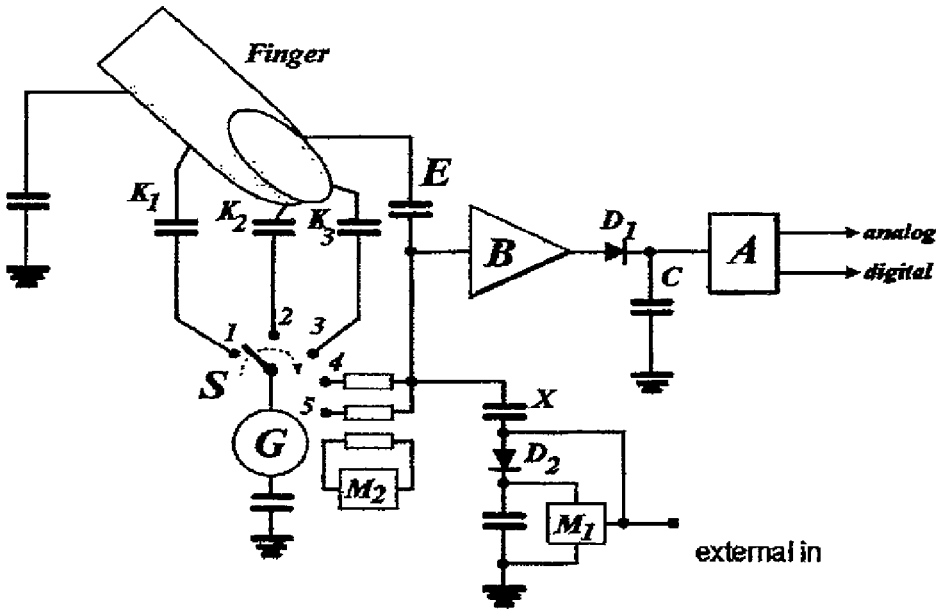
FIG. 10 is a circuit diagram illustrating the design of an inventive user interface unit.

FIG. 10 shows the principle design of a simple user interface unit (HMI) that works in the inventive combined fashion. A sequencer S runs through for example stages 1 through 5. Hereby a signal generated by generator G is applied to these stepwise switched capacitive electrode surfaces that in a specific instance is an advantageous component of the invention. Thus, for example, the electrodes K1, K2 and K3 can capacitively input power into the receiving electrode E. Dependent on a user's respective finger or hand position, different direct currents are generated behind the buffer B on the diode D1 and the condenser C1 that can be evaluated by evaluation unit A. The result can be processed analog or digitally.

If the sequencer reaches position 4, it inputs its alternating current signal through a resistor R to the buffer and at the same time to another coupling electrode X. If a modulator M1 is connected to the above the alternating current is rectified by the diode D2 and fed to a small buffer condenser. M1 can now modulate the alternating field using a modulation device field in such a way that this has an effect before and after the buffer B and it can again be evaluated via D1 and C. In particular, in this case objects can be temporarily introduced (equipped with M1) into the alternating field. This can be a signal or code transmitter or also microphones that feed the speech signals into the system. The sequencer reaches switch position 5. There it can excite a coil that can supply and search an additional modulator M2 using a magnetic coupling. This is similar to a transponder. The distance between the two coupling coils and the modulation signal is significant. Both appear on the buffer B and can be evaluated in the evaluation unit A. It is worth noting that the sequencer only uncouples the signal generated by generator G on electrode surfaces (except for point 5) and as such consumes very little power since these circuits contain no heavy-duty loads. That is especially important for battery-operated systems.

The modulators M1 and M2 described above can be simple oscillators that can also be changed by external physical dimensions, and therefore act as sensors. The change can affect frequency, amplitude or duty cycle or in a combination of these. In this way, virtually any physical dimension can advantageously introduced wirelessly in the inventive sensor system realized using an alternating field, and used by the buffer B and the evaluation unit A, without requiring special circuit measures. In particular, the coupling position X is especially flexible because it can serve a virtually unlimited number of different modulators.

Figure 11:
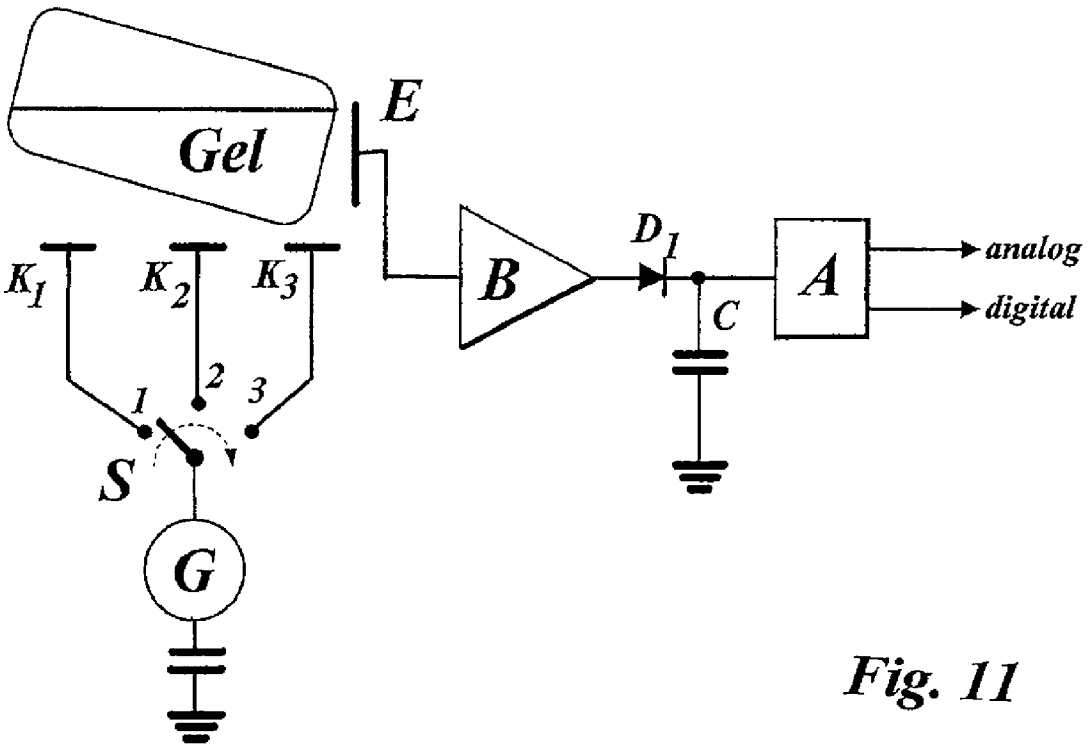
FIG. 11 is a circuit diagram illustrating a circuit variant for generating signals that as such correlate with a fluid shift.

FIG. 11 shows a concept through which the capacitive coupling surfaces K1, K2, K3 can also detect a bag with a gel-like liquid. Through movement the liquid and with it the dielectric is changed between the coupling surfaces to coupling surface E. As a result, acceleration, deceleration and position-dependent processes can be represented in a very simple fashion. It is even possible to do this in combination with a human hand (or other limbs or objects) and therefore to detect position and gesture-dependent situations simultaneously.

The above-described gel could also be changed in its dielectric properties due to optical or thermal effects, which can be determined. It is also possible to introduce small metal particles in the gel so that it can also react to the outside magnetic fields that was similarly simple to prove by the inventive, such that the position and acceleration-dependent properties of the gel are retained. This is also an advantage achieved through the inventive concept.

It is possible to easily house such a circuit in a toy. This toy can then be touched by the user at various locations or controlled by proximity. It is further possible to detect the position of the toy without requiring special additional circuit measures. The capacitive or magnetic components equipped with the modulators can also be brought close to the toy. As soon as they are fed the alternating field, the alternating current will be rectified and the modulators excited to modulate the alternating field. The inventive buffer B can feed this to the evaluation unit A. It is also possible to attach a kind of clip-on microphone to the toy in order to "talk with the toy." This microphone can be removed later. It requires neither batteries nor special contact measures. It need only be fed by the capacitive (or magnetic) alternating field and have a possibility for capacitive feedback (for example ground). This can be done simply using capacitive coupling surfaces.

The inventive concept also makes it possible to apply alternating fields to larger fields. Another exemplary application shows this in a sales shelf. In this case the mentioned modulators M1, M2 can be affixed to different places near the sales-promoting articles. In case of proximity to human limbs the capacitive relationship to mass creates a current that causes the modulators to function and for example to be used as an ID that can be determined by the buffer B working as a server and the evaluation unit A. This makes it possible to determine which product a customer is interested in. An appropriate advertising film could, for example, be run on a nearby screen.

The inventive concept makes it possible using simple circuit measures to produce highly cost-effective multisensor systems that in particular react to human gestures, speech or other signals (HMI). The circuit consists essentially of a sequencer S, a generator G, a buffer B and an evaluation unit A. The number of capacitive electrodes that are essential for the invention can be determined on a virtually random basis by the sequencer's switch position.

It is possible to introduce modulators into the alternating fields produced by generator G that rectify the alternating field and drive modulation circuits with the thus obtained direct current that in turn can modulate the alternating field. This can be done by changing impedance or by applying any type of frequencies, in particular a transmitter on a frequency band shifted by the exciter band. It is also possible that the modulators do not have their own oscillators but rather divide the holder frequency supplied by the generator or by raising PLL stages to make possible transmission to a receiver.

The circuit comprises at least one simple buffer B, at least one simple rectification D1 and at least one simple evaluation A. This can, for example, take the form of an analog/digital converter (ADC). It is also possible to apply more complete analog and/or digital evaluation possibilities.

Figure 12:
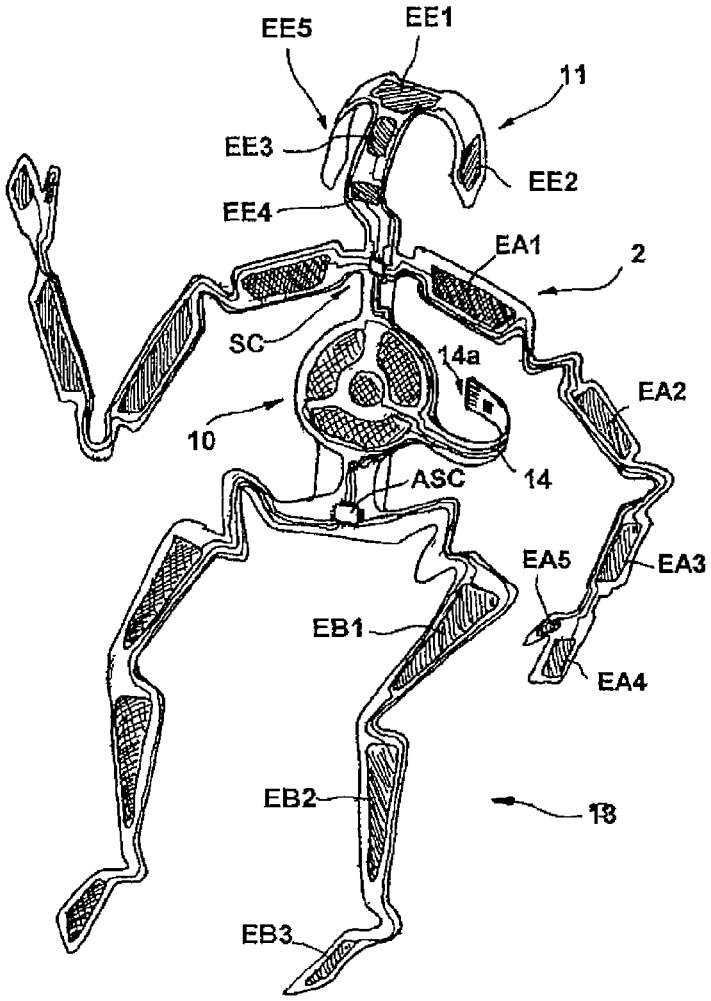
FIG. 12 is a perspective drawing illustrating an electrode insert for a doll through a flexible conducting foil holder structure, this electrode insert being provided with a circuit that enables with regard to proximity or field bypass effects to provide indicative signals in digital form to a service line section.

FIG. 12 shows an electrode holder designed as a doll insert in the form of a flexible circuit board. This electrode holder comprises a stomach electrode 10 that in the installed state is provided in the stomach area of the doll and in addition to detecting the proximity of a hand or finger to the stomach area also enables an at least rough determination of the spatial position of the hand or finger with respect to this stomach electrode 10. In particular a finger gesture detection can be determined using this stomach electrode. Also, the electrode holder comprises a head electrode 11 that in the embodiment shown here comprises electrodes EE1, EE2, EE3, EE4 and EE5. Using this head electrode 11 touching of the ear, nose, mouth, and forehead area of the doll head can be detected.

Also, an upper arm electrode E12 is connected as an electrode holder that as such comprises electrodes EA1, EA2, EA3 as well as hand electrodes EA4 and EA5. These electrodes can be used to detect touching of the corresponding shoulder, arm and hand areas. The hand electrodes EA4 and EA5 can be controlled in such a way that they can especially effectively determine an object approached by a hand or an object grasped by this hand by field bypass.

In the shown embodiment the electrode holder also comprises a leg electrode 13 through that contact, or proximity to the thigh area, the shinbone area and the foot area can be detected. The leg electrode 13 is provided with leg electrodes EB1, EB2 and EB3.

The above electrodes, which are attached preferably directly on the electrode holder, are controllable. The control can take the form of these electrodes being able to determine the existence of a modulated electrical field. It is also possible to successively connect these electrodes with a power generator in order for generating temporary electrical alternating fields through these electrodes. The sensor system can be designed in such a way that a field electric field bypass between certain electrodes of the electrode system can also be detected.

Preferably, a circuit ASC is connected to the electrode holder through the current application of the individual electrode sections and the detection of the input signals is established. This ASC circuit is preferably designed in such a way that an additional doll control can be provided through these detected events as digital signals via a service line 14. In the embodiment shown here the service line 14 designed as part of the electrode holder and comprises a flat contact section 14*a*.

The electrode holder is designed in such a way that the capacity of a respective electrode section formed by a condenser system can specifically be determined. This is in particular enabled by each electrode section being assigned an electrode identifier in the form of a natural number or an activation time. This concept makes it possible to determine either the time for an electrode-specific cycle number, or the cycle number for an electrode-specific time.

Preferably at least one sequencer circuit SC can be provided on the electrode holder through which the individual electrode sections EA1, EA2 . . . , EE1 . . . , EE5 can be successively integrated in the detection circuit. The shown embodiment provides 24 electrode sections. The detection cycle number lies in the range of 700 to 1200 cycles. The individual electrode sections EA1, EA2 . . . , EE1 . . . , EE5 can therefore be specified by cycle number values with an distance of 50 cycles.

For example, electrode section EA1 is assigned the cycle number 700. As soon as this cycle number is reached, a transfer by the oscillation system occurs to the electrode section EA2, another transfer then occurs for example for the cycle number 750, which is specific to EA2. This transfer procedure is done successively for all electrode sections EA1, EA2 . . . , EE1 . . . , EE5, . . . EB3 until successively all electrode sections were briefly switched on via the sequencer circuit SC respectively for the section specific cycle number. Between the transfer there is preferably a delay with a predetermined duration or empty cycle number. It is also possible for the duration of the delay, or the empty cycle number to export information from the sequencer, which advantageously provides information on which electrode section was active before or after. Since the frequency of the LC networks formed by the electrode sections EA1, EA2 . . . , EE1 . . . , EE5 changes depending on certain proximity states, the time length T also changes for the "working off" of the number of oscillation cycles determined for each electrode section. This duration T correlates directly with the capacity of a LC network realized including the respective electrode section. To detect a proximity or distance process it is sufficient only to detect the change in the respective duration. This process is highly insensitive to drift and detuning effects. The duration T can be read directly from a timer as a digital value. The address of the associated electrode section is taken directly from the cycle number value of a counter taken parallel to the time measurement.

Calibration circuits can be provided on the electrode holder, in particular calibrated coupling condensers to somewhat offset the oscillation behavior of the individual electrode sections controlled by the sequencer. The leads are preferably realized as shielded leads. The flexible conductor material used is preferably designed multilayer so that the shielding surfaces can be formed by parallel covering plies. The entire electrode holder is preferably provided on both sides with an insulating covering ply, in particular covering foil so that no direct contact of the electrode sections is possible.

The electrode sections EA1, EA2 . . . , EE1 . . . , EE5 can also be wired in another fashion. In particular it is possible to detect the field bypass effects between certain electrode sections. Instead of detecting change in the dielectric properties in the vicinity of the respective electrode sections by detecting the capacity with respect to ground it is also possible to execute the electrode sections divided, or with directly adjacent counter-electrodes, and thereby to detect the capacity change in the form of a change in field bypass. This approach is also realizable in combination with the above concept of identifying the electrode sections by cycle number or length of action.

A plurality of sequencer circuits can be provided as circuits on the electrode holder. This sequencer can in turn be controlled by a sequencer or multiplexer connected in series.

It is also possible to control the individual electrode sections EA1, EA2 . . . , EE1 . . . , EE5 using a parallel or serial bus system control.

In particular in case of the application of the inventive electrode holder to a doll or an animal-like toy it is possible corresponding to the touching of certain areas of the toy to have meaningfully coordinated speech produced. When touching the doll's nose it can for first sneeze and then answer "Meine Nase—my nose" and then reproduce an additional text. The speech or sound effects assigned to this detection event "nose touched" should be preferably as described above coordinated by a special control register so that no monotony is recognizable in the reaction behavior.

Figure 13:
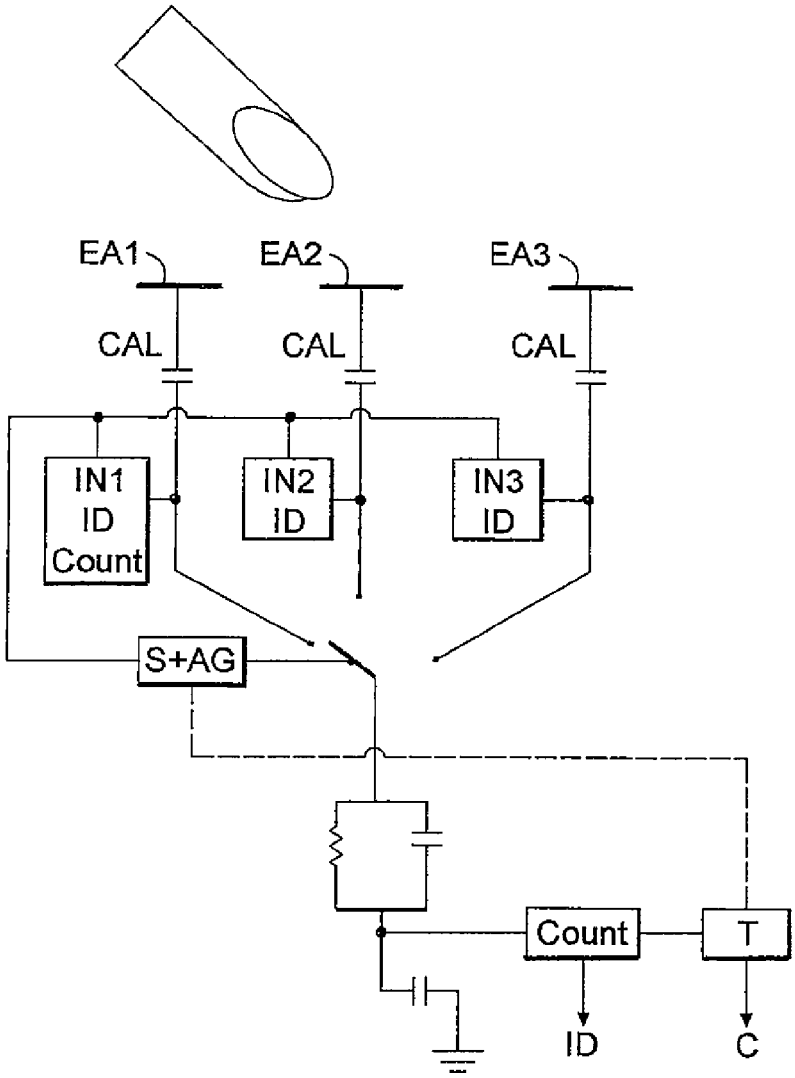
FIG. 13 is a circuit diagram illustrating a circuit variant for generating signals at which the individual electrode sections can be identified by an indicative count value for the respective electrode section.

In FIG. 13, the principle design is shown of an inventive circuit with electrode sections identified by cycle numbers. The count function to transfer to the sequencer can also be provided by a counter in the sequencer and provides by itself for a respective connector port a certain cycle number and a transfer delay. Instead of duration T it is also possible, to obtain information on the capacity of the respective active electrode section EA1, EA2, EA3 through the power line.

Figure 14:
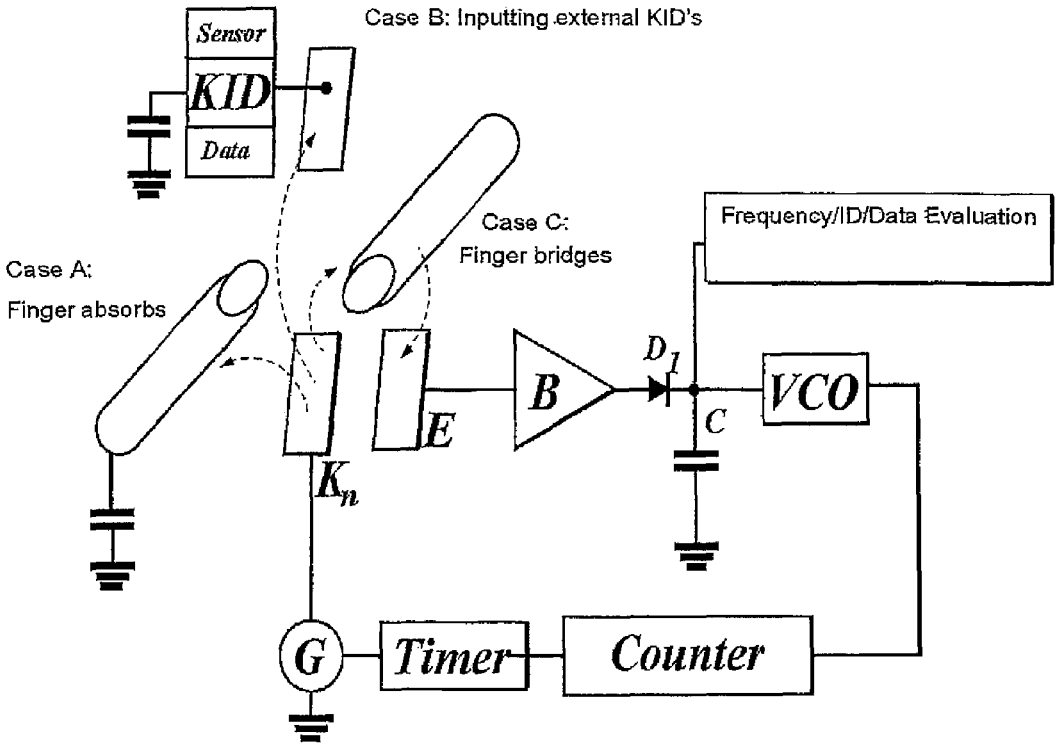
FIG. 14 is a circuit diagram illustrating a circuit variant in which a count value generated by a connect cycle can describe the current field coupling to a receiving electrode and where appropriate a frequency or data evaluation of signals from external field electric signal transmitters can also take place.

FIG. 14 shows a circuit diagram illustrating a circuit variant where though a count value generated by a given connect cycle the current field input coupling to a receiving electrode can be described and where appropriate a frequency or data evaluation of signals of external field electric signal transmitters can also be performed. The generator sends a sequence to a transmitting electrode Kn and thereby transmits capacitively depending on the external bypass effect of a field a current to the receiving electrode E. This current on the receiving electrode E is converted to direct current by the buffer B. The VCO connected by diode D1 is operated by the current supplied by buffer B and drives the counter (counter, for example multiplying). Since the sequence is temporally limited by a sequencer, or multiplexer not described here in greater detail, it is possible, to obtain a closely correlated reading with the current field bypass state between the transmission electrode Kn and the receiving electrode E, by simply reading and then resetting the counter. This procedure is repeated cyclically using a given delay. Using the where appropriate changing counter values, the movement dynamics of a body in particular of a finger, can be detected by the generated field bypass.

Using these systems in an especially advantageous fashion signals can also be detected that are external signal transmitters—for example the KID circuit shown here—provided by field modulation. These data can where appropriate be fed to an evaluation circuit, and if they meet a signal criterion where appropriate directly fed to a prestage of a sound reproduction system, in particular a piezoelectric speaker.

Figure 15:
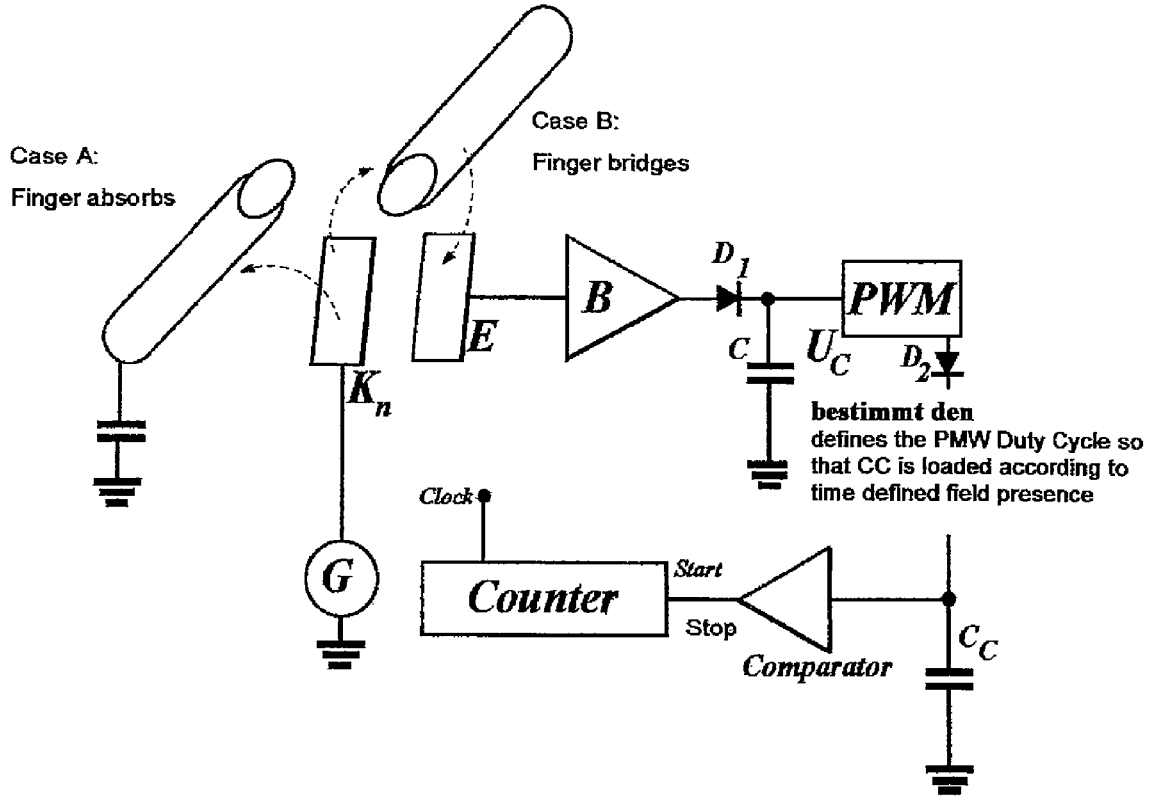
FIG. 15 is a circuit diagram illustrating a circuit variant in which similarly a count value generated by a connect cycle can describe the current field input coupling to a receiving electrode.

FIG. 15 shows a circuit diagram illustrating a circuit variant in which similarly the current field input coupling to a receiving electrode can be described by a count value generated each connect cycle. Unlike the variant according to FIG. 14, here a pulse width of a square-wave voltage is changed through the field current that charges a condenser until a switch criterion is reached on a Schmitt trigger (comparator). Up to this switch point a counter runs with a where appropriate programmably adjustable rate. Also in this circuit variant the count value provided by the counter correlates closely with the field bypass effect caused by external objects.

Figure 16:
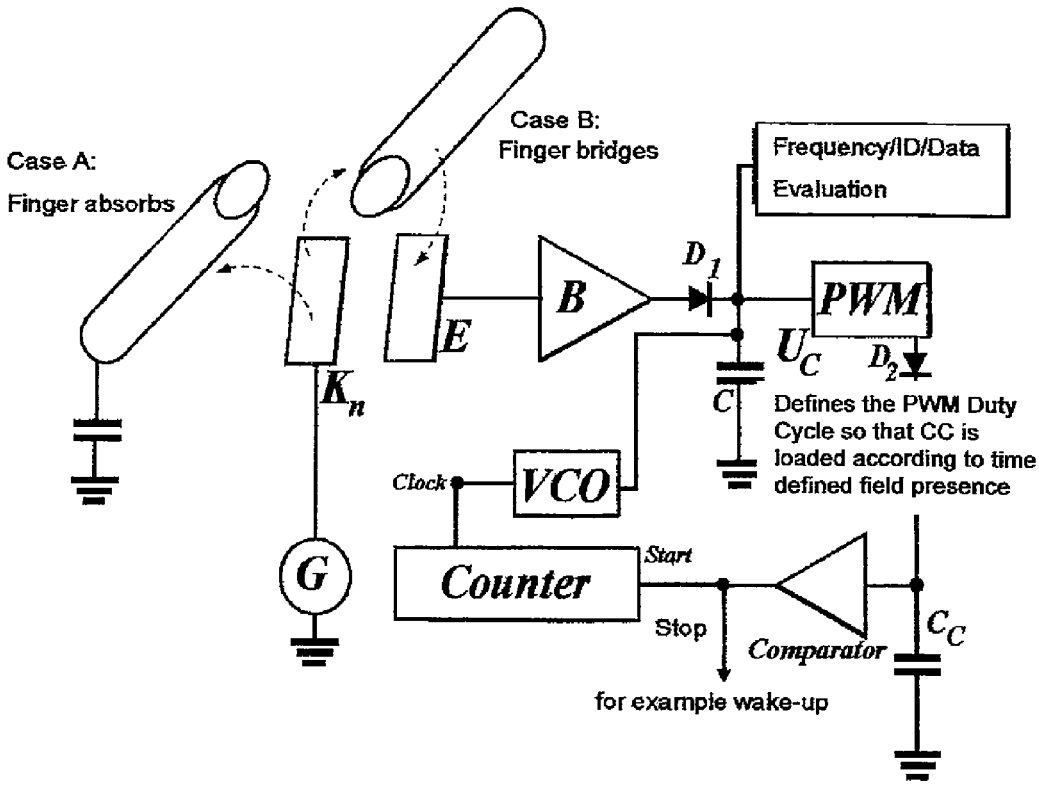
FIG. 16 is a circuit diagram similar to FIG. 15 illustrating a circuit variant in which by a count value generated per connect cycle the current field input coupling to a receiving electrode can be described and analogous to FIG. 14 also a frequency or data evaluation signals of external field electric signal transmitters can be performed.

FIG. 16 shows a circuit diagram similar FIG. 15 illustrating a circuit variant in which through a count value generated by a given connect cycle the current field input coupling on a receiving electrode can be described and, analogous to the circuit according to FIG. 14, also a frequency or data evaluation of signals from external field electric signal sensors can be performed.

The measures described above for the field-electric input coupling of external signals, which are suitable for speech reproduction, the providing of speech reproduction data through a data medium element attachable to the toy, the various combinations of the referenced sensor systems, the generating of certain data content the area of the accessory toy, the reading aloud from accessory books, and in particular the input coupling of signals that are provided though accessory toys in the doll including the playing child in the signal transmission path can also be regarded as independent inventive solution complexes.

I claim:

1. A toy comprising:

a body;

an audio output on the body;

a memory in the body storing a plurality of elements of different audio data;

a sensor on the body for detecting different movements of objects adjacent the body, wherein the sensor comprises an electrode which is coupled with an oscillator to emit an electric alternating field and a detector configured to detect amplitude changes in the electric alternating field when an object enters the electric alternating field and further configured for generating respective detection signals corresponding with the different movements; and a controller in the body connected to the output, to the memory, and to the sensor for selecting from the memory a one of the elements of audio data according to the generated detection signal and for playing the selected audio-data element via the output.

2. The toy defined in claim 1 wherein the sensor is capable of detecting a user's hand.

3. The toy defined in claim 2 wherein the sensor is designed as a gesture sensor.

4. The toy defined in claim 3 wherein the gestures are recognized by the controller.

5. The toy defined in claim 4 wherein the sensor can distinguish between different paths of movement of the hand, whereby gestures can be interpreted.

6. The toy defined in claim 5 wherein the movements as path of movement can be broken down and evaluated along two axes.

7. The toy defined in claim 5 wherein the dynamics of the motion are also detected by the sensor.

8. The toy defined in claim 1 wherein an electronic circuit component represents the object detected by the sensor.

9. The toy defined in claim 1 wherein the detector is a synchronous detector.

10. The toy defined in claim 1 wherein the sensor comprises a transmitter electrode coupled with said oscillator and a receiving electrode coupled with said detector.

11. The toy defined in claim 1 wherein the toy is provided with actuators.

12. The toy defined in claim 11 wherein the actuators cause movement of an arm, lips, eyes and or different body movements of the body.

13. The toy defined in claim 12 wherein the body movements are related to a detected proximity event.

14. The toy defined in claim 1 wherein the sensor comprises a torso electrode.

15. The toy defined in claim 1 wherein the sensor comprises two hand electrodes.

16. The toy defined in claim 1 wherein the sensor comprises two foot electrodes.

17. The toy defined in claim 1 wherein the sensor comprises a head electrode.

18. The toy defined in claim 1 wherein the sensor configuration comprises a position sensor.

19. The toy defined in claim 1, further comprising an interface electrode to input couple a signal carrying a data string.

20. The toy defined in claim 1 wherein the sensor comprises an accelerometer.

21. The toy defined in claim 1, further comprising a clock.

22. The toy defined in claim 1, further comprising an interface.

23. The toy defined in claim 1, further comprising eyes and a camera integrated into at least one of the eyes.

24. The toy defined in claim 23 wherein picture data generated by the camera is stored in a memory integrated in the toy.

25. The toy defined in claim 24 wherein the picture data is subject to text recognition.

26. The toy defined in claim 25 wherein speech reproduction occurs according to evaluation of the text data.

27. A toy comprising: a body; an actuator in the body configured to moving a part of the body; a memory in the body storing a plurality of elements of different body movement; a sensor on the body for detecting different movements of objects adjacent the body, wherein the sensor comprises an electrode which is coupled with an oscillator to emit an electric alternating field and a detector configured to detect amplitude changes in the electric alternating field when an object enters the electric alternating field and further configured for generating respective detection signals corresponding with the different movements; and a controller in the body connected to the actuator, to the memory, and to the sensor for selecting from the memory a one of the elements of body-movement data according to the generated detection signal and for effecting the selected body movement via the actuator.

28. The toy defined in claim 27 wherein the object movement is detected at an area in front of a torso of the body.

29. The toy to claim 28 wherein the object movement is detected at a foot area of the body.

30. The toy defined in claim 27 wherein dynamics of the object movement are evaluated.

31. The toy defined in claim 1 wherein the sensor comprises an electrode with a plurality of locally distributed electrode sections forming a sensor system responding to changes in the electric alternating field emitted by at least one electrode section in the vicinity of the respective electrode section, wherein the oscillator is part of an exciter circuit, and a circuit through which the individual electrode sections of the electrode are successively connectable to the exciter circuit.

32. The toy defined in claim 31 wherein activation of the electrode sections to the exciter circuit is done in such a way that the individual electrode sections are successively coupled with the exciter circuit with an oscillation frequency unique to the respective electrode section.

33. The toy defined in claim 31 wherein the duration for the working off of the oscillation cycles is detected, and is processed as the capacity of the condenser correlating with the dimension of the respective active electrode section.

34. The toy defined in claim 1 wherein the sensor comprises an electrode with a plurality of locally distributed electrode sections forming a sensor system responding to changes in the dielectric properties in the vicinity of the respective electrode section, the toy further comprising a wake-up circuit operated via this electrode that in the event of the absence of certain detection events places the toy into an energy saving mode and then with decreased energy consumption with lower sample rate proximity detection returns to a normal operating mode.

* * * * *